United States Patent [19]

Ozaki

[11] Patent Number: 4,991,524

[45] Date of Patent: Feb. 12, 1991

[54] DEVICE FOR AUTOMATICALLY MAKING EMBROIDERING DATA FOR A COMPUTER-OPERATED EMBROIDERING MACHINE

[75] Inventor: Yoshiaki Ozaki, Tokyo, Japan

[73] Assignee: Janome Sewing Machine Co., Ltd., Tokyo, Japan

[21] Appl. No.: 490,532

[22] Filed: Mar. 5, 1990

Related U.S. Application Data

[63] Continuation of Ser. No. 315,461, Feb. 24, 1989, abandoned.

[30] Foreign Application Priority Data

Feb. 26, 1988 [JP] Japan ..... 63-41899

[51] Int. Cl.[5] ..... D05B 21/00

[52] U.S. Cl. ..... 112/121.12; 112/457; 112/103; 364/470

[58] Field of Search ..... 112/121.12, 121.11, 112/103, 102, 457, 2, 456; 364/470

[56] References Cited

U.S. PATENT DOCUMENTS

| | | | |
|---|---|---|---|
| 4,290,375 | 9/1981 | Tonomura et al. | 112/121.12 |
| 4,526,116 | 7/1985 | Mannel | 112/121.12 X |
| 4,660,484 | 4/1987 | Yasui | 112/121.12 X |
| 4,691,649 | 9/1987 | Takano et al. | 112/121.12 |
| 4,834,007 | 5/1989 | Miyazaki et al. | 112/457 X |

*Primary Examiner*—Peter Nerbun

*Attorney, Agent, or Firm*—Michael J. Striker

[57] ABSTRACT

The outline of a pattern is read out by an input device of a digitizing image scanner where embroidering data for a zigzag embroidering, a lower thread embroidering, or a cross-stitch embroidering are selectively and automatically prepared. The embroidering data and the embroidering sequence for different patterns can be made very easily and rapidly. In cooperation with a computerized sewing machine, the device makes it possible to carry out a wide range of embroidering.

1 Claim, 8 Drawing Sheets

| APEXES | SEQUENCE BLOCKS | OFFSET BLOCKS | |
|---|---|---|---|
| $P_S$ | $B_S$ | | |
| $P_1$ | $B_1$ | | |
| $P_2$ | $B_S$ | $B_2$ | $B_1$ |
| $P_3$ | $B_2$ | $B_3$ | $B_4$ |
| $P_4$ | $B_4$ | | |
| $P_5$ | $B_5$ | | |
| $P_6$ | $B_3$ | $B_6$ | $B_5$ |
| $P_7$ | $B_6$ | | |

TABLE 1

| APEXES | SEQUENCE BLOCKS | OFFSET BLOCKS | |
|---|---|---|---|
| $P_S$ | $\cancel{B_S}$ | | |
| $P_1$ | $\cancel{B_1}$ | | |
| $P_2$ | $\cancel{B_S}$ | $\cancel{B_2}$ | $\cancel{B_1}$ |
| $P_3$ | $\cancel{B_2}$ | $B_3$ | $(B_4)$ |
| $P_4$ | $B_4$ | | |
| $P_5$ | $B_5$ | | |
| $P_6$ | $B_3$ | $B_6$ | $B_5$ |
| $P_7$ | $B_6$ | | |

TABLE 2

TABLE 3

| $i$ | $P_i$ | $B_i$ | $Z$ |
|---|---|---|---|
| 0 | $P_S$ | $B_S$ | 1 |
| 1 | $P_2$ | $B_1$ | 0 |
| 2 | $P_1$ | $B_1$ | 1 |
| 3 | $P_2$ | $B_2$ | 0 |
| 4 | $P_3$ | $B_4$ | 0 |
| 5 | $P_4$ | $B_4$ | 1 |
| 6 | $P_3$ | $B_3$ | 1 |
| 7 | $P_6$ | $B_5$ | 0 |
| 8 | $P_5$ | $B_5$ | 1 |
| 9 | $P_6$ | $B_6$ | 1 |
| 10 | $P_7$ | | |

FIG.19

DEVICE FOR AUTOMATICALLY MAKING EMBROIDERING DATA FOR A COMPUTER-OPERATED EMBROIDERING MACHINE

RELATED APPLICATIONS

This application is continuation of application Ser. No. 315,461 filed Feb. 24, 1989, now abandoned, and entitled "A Device for Automatically Making Embroidering Data for a Computer Operated Embroidering Machine".

FIELD OF THE INVENTION

The present invention relates to a device for automatically making embroidering data for carrying out embroidering of patterns by means of a computer operated embroidering machine.

BACKGROUND OF THE INVENTION

Since there has not conventionally been a device for automatically making data for embroidering patterns, a machine operator manually moved an input device such as an image scanner or a digitizer from a starting apex point of the pattern to a finish end point thereof, while keeping appropriate spaces between two adjacent stitch points in vertical as well as lateral directions. It was further required to divide a large pattern into a plurality of blocks to be sequentially stitched. Therefore, the operation was complicated and took much time.

SUMMARY OF THE INVENTION

The object of the present invention is to make embroidering data easily, rapidly and automatically.

For preparing the embroidering data of the desired pattern, the operator inputs the original pattern into a preparing device, where the pattern outline is divided into blocks suitable for the embroidering, and each of the blocks is arranged successively for a stitching sequence suitable for the embroidering, and the embroidering data are read out easily and rapidly.

The preparing device according to the invention is comprised in a computerized sewing machine provided with a fabric embroidering frame which spreads a fabric as a work thereover, and is moved in X or Y directions by means of driving parts; and memories which store data controlling the embroidering frame in X or Y direction. The preparing device is designed for making the embroidering data of a pattern to be formed on the surface of the fabric by cooperation of the sewing machine and the embroidering frame. The preparing device reads in the outline of a desired pattern by means of input which scans the pattern in a predetermined direction, detects all the apexes of the concave portions and convex portions on the outline of the pattern, ahnd registers, the apexes as P, in the data memory. The preparing device divides pattern into blocks B by the line scanning the apexes P, registers each of the blocks B in the memory while making an apex-block diagram to determine a sequence for stitching the blocks.

BRIEF DESCRIPTION OF THE DRAWINGS

FIG. 19 is a P-B tables 1 to 3.

DETAIL DESCRIPTION OF PREFERRED EMBODIMENTS

Figure 1:
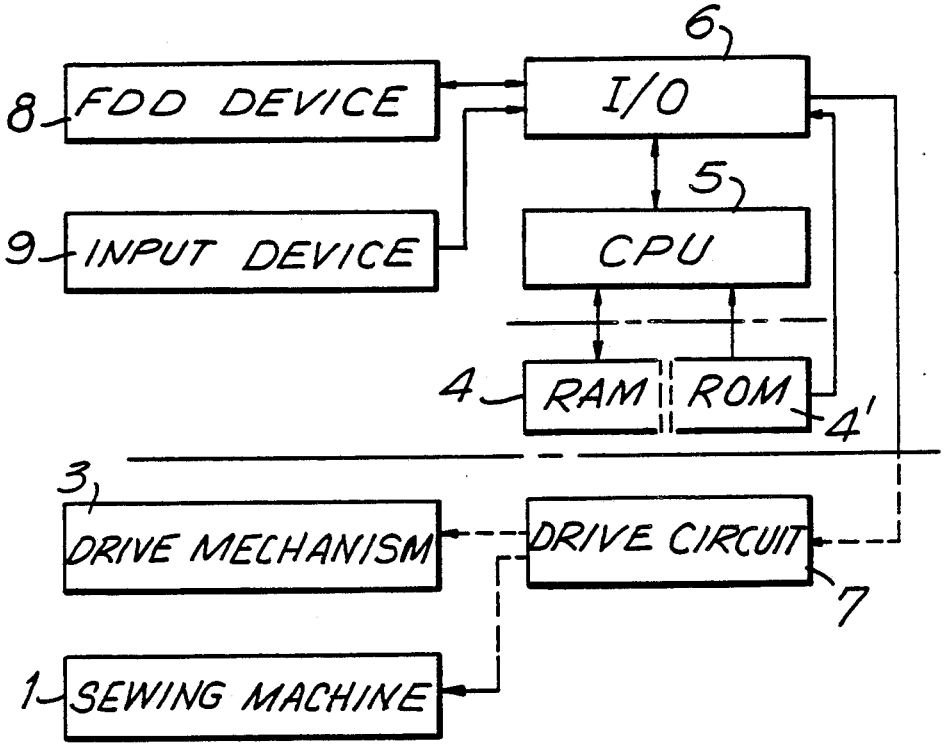
FIG. 1 is a block-diagram of the machine of the invention.

Embodiments of the invention will be explained with reference to the attached drawings, where, in FIG. 1, the reference numeral 1 designates a sewing machine and an embroidering frame mounted on the sewing machine and controlled by an X-Y coordinate drive mechanism 3. Memories (RAM, ROM) 4, 4' store control signals to be transmitted through a central processing unit (CPU) 5 and an input-output device (I/O) 6 to a drive circuit 7 and further to the X-Y coordinate drive mechanism 3.

The reference numeral 8 designates an external memory (FDD), and the control data therein can be stored in the memory 4 via the input-output device 6. An input device 9, a digitizer or an image scanner for preparing embroidering data for a desired pattern, is connected to the memory 4 via the input-output device 6.

Figure 2:
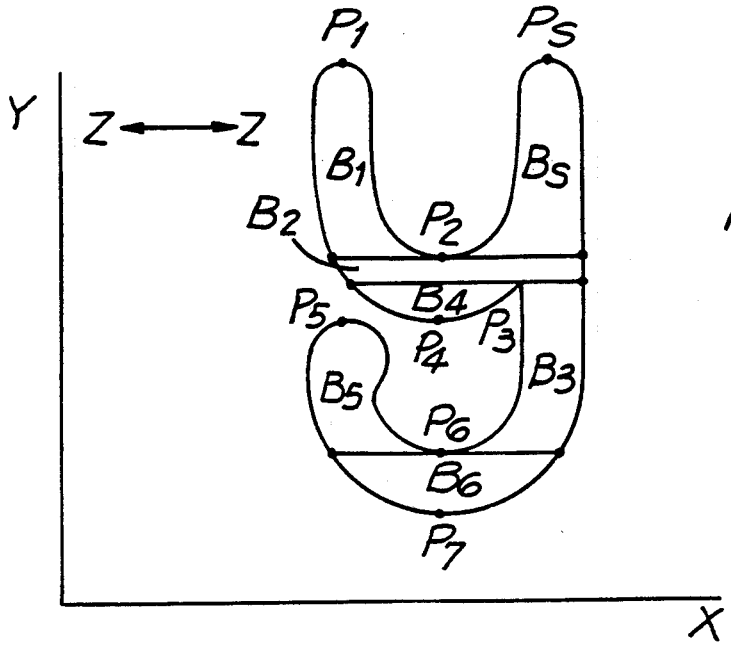
FIG. 2 is a pattern divided into blocks according to the invention.

In the above-mentioned structure of the invention, when forming patterns such as letters or numbers by embroidering, for example, a letter "y" as shown in FIG. 2, the outline of the pattern is at first read out by the input device 9, and corresponding data are input into the memory 4. The pattern is scanned in an appropriate direction (Z—Z direction in FIG. 2), so that apex and recess points of the pattern are all detected and these apex and recess points are registered as apexes P1-n in the data memory 4. Then the portions of the pattern divided by the lines scanning through each of the apexes P1-n of the pattern are registered as blocks B. Subsequently, a diagram of the blocks Bi-n divided by the apexes Pi-n that is, P-B diagram (FIG. 3) is made up with an embroidering start point Ps being designated, and the the diagram is registered in the memory in a form of Table 1.

Figure 3:
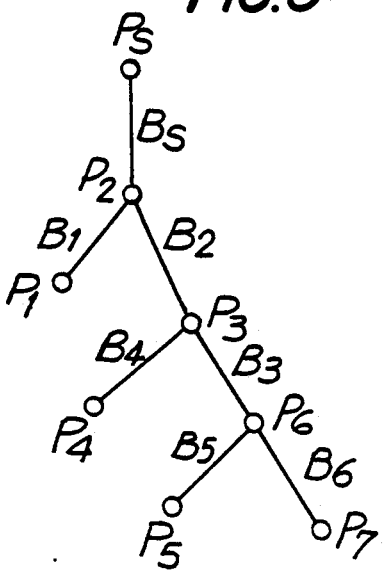
FIG. 3 is a diagram showing offset points and offset blocks of the divided pattern.

The FIGS. 2 and 3, the apexes P, $P_4$, $P_5$ and $P_7$ are stitch termination points, and the recess points $P_2$, $P_3$, $P_6$ are stitch offset points.

A stitching sequence of the offset blocks is determined by comparing accumulated values of the stitching areas to sufficiently stitch the pattern.

Figure 18:
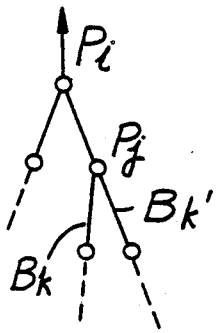
FIG. 18 is a diagram for explaining the calculation of accumulated areas according to the invention.

The calculation of the accumulated values is as follows (refer to FIG. 18).

S(Pi, Bj): Accumulation of the stitching area when stitching from the offset point Pi to the block Bj;

(Bj): Area of Bj block;

S(Pj, Bk): Accumulation of the stitching area from the offset point Pj to the block Bk;

Pj: The offset point of termination of Bj block;

Bk, Bk': The offset blocks from the Pj offset point; and

S(Pi, Bj)=(Bj)+S(Pj, Bk)+S(Pj, Bk').

This calculation is carried out toward the offset point (Pi) from a stitch termination point with a limited S value being 0.

The above-mentioned stitching area S is calculated at each of the offset points for each of the offset blocks. The calculated offset blocks are prearranged in Table 1 so that the blocks of larger value are placed to the left side, and those of a smaller value are placed to the right side.

Figure 4:
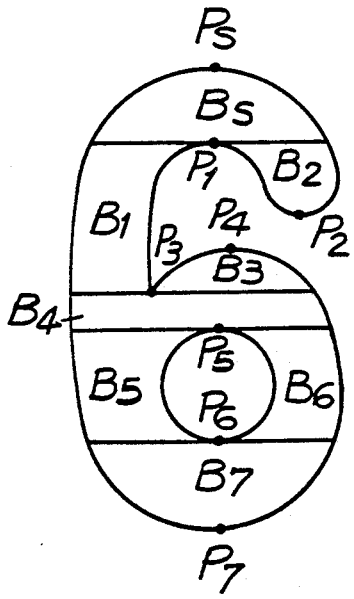
FIG. 4 is another pattern divided into blocks according to the invention.
Figure 5:
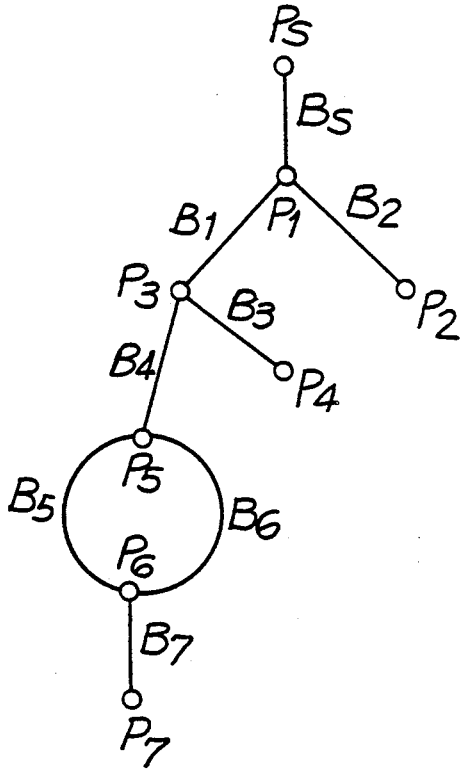
FIGS. 5 and 6 are diagrams showing offset points and offset blocks of the divided pattern of FIG. 4.

A pattern shown in FIG. 4 has a circular blank part such as numeral "6". In this case, P-B connections are shown, and an apex-block diagram may be formed.

Figure 6:
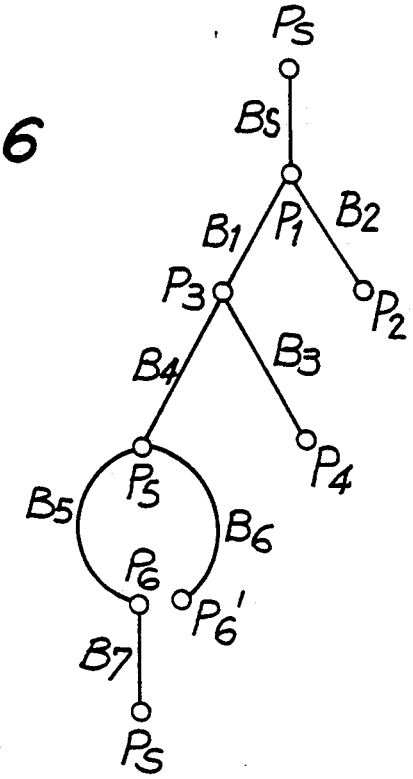

However, in this diagram including the circular line, the stitching area cannot be calculated at the offset points. It is, therefore, necessary to cut off the circular line at a proper part as shown in FIG. 6 where the termination P6' of the block B6 is separated from the termination P6 of the block B5.

Figure 7:
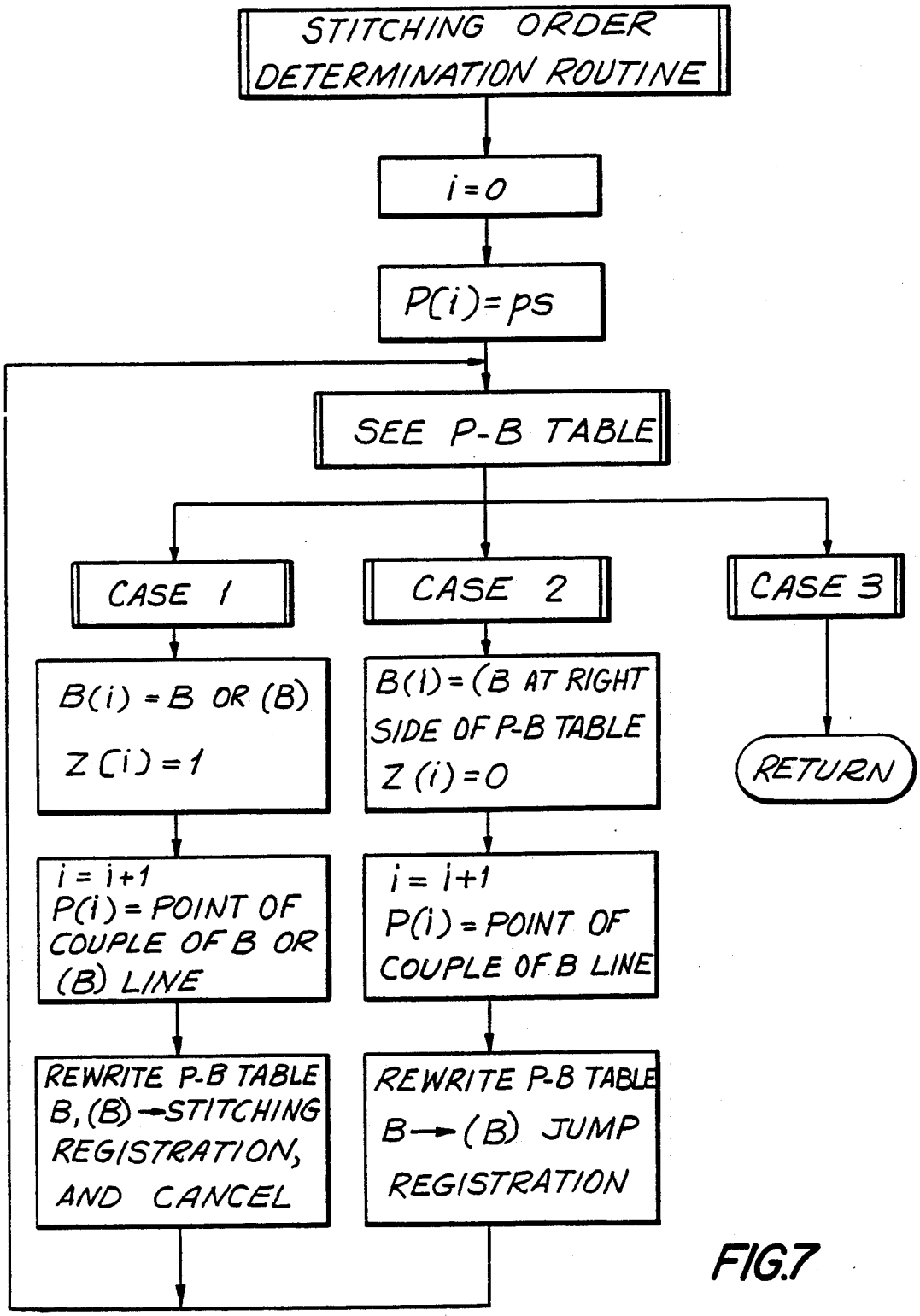
FIG. 7 is a flow chart of the program for the device of the invention.

A further reference will be made to table 3, FIGS. 2 and 3, and the routine of FIG. 7 showing a flow chart of the programming sequence for automatically embroidering the blocks.

In the flow chart, "i" represents and order or sequence of the registered data, P(i) is an offset point through which the stitching is continued or a termination point in the stitching sequence, B(i) is a block to be sequatially registered. Z(i) shows distinctions as to whether the blocks are to be registered to have a stitch (0) jumping to adjacent block or the zigzag stitches (=1) to be formed therein. Ps shows a designated start point, and this designated Ps is stored in P(O).

"See P-B Table" in the flow chart means to refer to B, (B) of the apex-block Table 1, and the data treatment is divided by the data into the following three CASEs:

CASE 1: Block B or (B) in only one,

CASE 2: Blocks B are more than two, and

CASE 3: neither Block B or (B) (registered).

Table 2 shows treating the stitching sequence. The blocks B are not yet registered in B(i). (B) shows a block registered as the pump stitching in B(i), and if the block is registered in B(i) as the zigzag stitching, and block B is cancelled from Table, for example, it is described as "B". The stitching sequences required in this treatment are shown at P, B, Z of Table 3.

The generation of the zigzag embroidering data will be now explained. When the data is Z(i)=0 for some of B(i) of the stitch sequence data from "i=0" to "end", such data is registered for jumping from P(i) to P(i+1) so as to prevent the stitches from setting out of the outline of the block being stitched, or to make straight stitching from Pi to P(i+n).

On the other hand, when the data is Z(i)=1, the block B(i) is registered as being stitched with zigzag stitches from P(i) to P(i+1).

Figure 8:
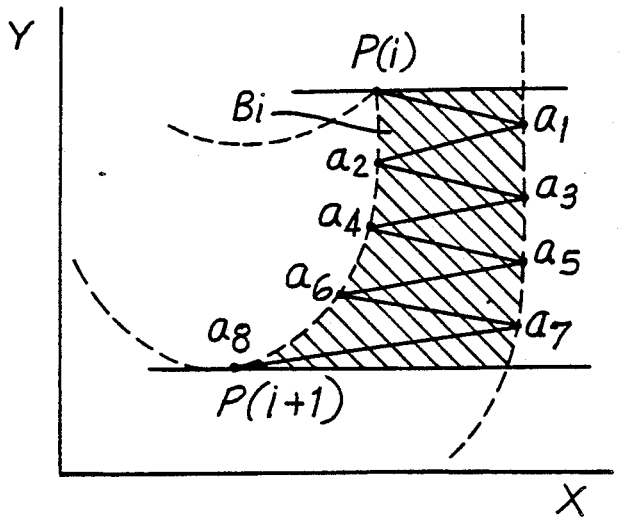
FIG. 8 is an enlarged block to be stitched and shown in FIG. 2.

Further, with reference to FIGS. 7 and 8, assuming that a hatched part between P(i) and P(i+1) is B(i), the stitching block is divided with a desired pitch, and X Y data of a1, a2 . . . a7 are sequentially arranged for stitching the area with the zigzag stitches.

Figure 9:
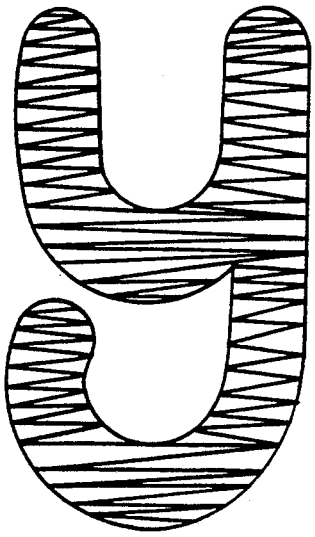
FIG. 9 is an embroidered pattern of the invention.
Figure 10:
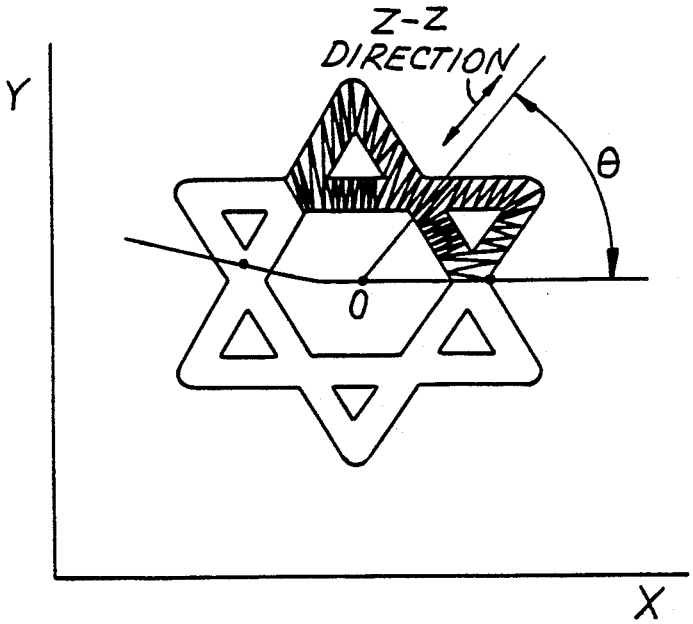
FIG. 10 is an embroidered pattern in another embodiment of the invention.

FIG. 9 shows the embodiment of a zigzag embroidered pattern of FIG. 1. FIG. 10 shows the embodiment of another pattern which varies an inclination angle $\theta$ around the center O so as to vary zigzag direction.

Figure 11:
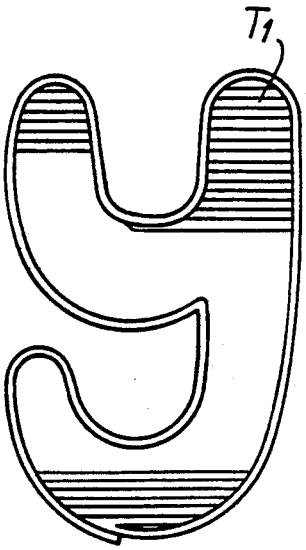
FIG. 11 is an embroidered pattern showing the stitches with a lower thread according to the invention.

Another embodiment refers to the embroidering by the lower thread. FIG. 11 shows a pattern embroidered with the lower thread.

In this embodiment, a stitched pattern appears on the inside surface of a fabric. Therefore this embroidering depends upon a process that the fabric to be stitched is expanded on the frame of an embroidering machine such that the outside surface of the fabric is in contact with the bed of the machine; a thick color thread is used as the lower thread; and the tension of an upper thread is made stronger than that of a lower thread, so that the upper thread is not allowed to appear at the bed side. T1 of FIG. 11 designates the lower thread. The outline of the figure is stitched with the straight stitching in parllel. The input data must be converted with X=-X with respect to the input pattern for embroidering the inside of the fabric which is turned with the down side up as shown in FIG. 11. The embroidering pattern is formed with a lower thread and not the upper one.

Figure 12:
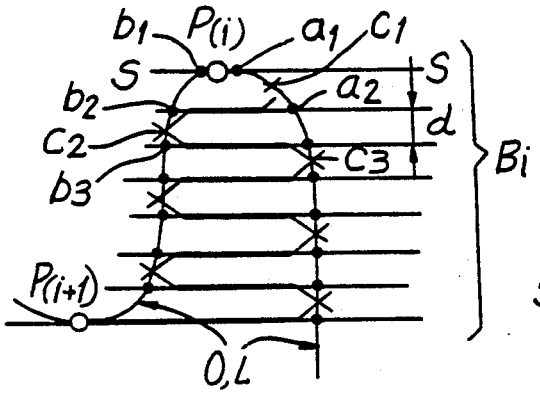
FIGS. 12 and 13 are enlarged partial views of the embroidering pattern shown in FIG. 11.
Figure 13:
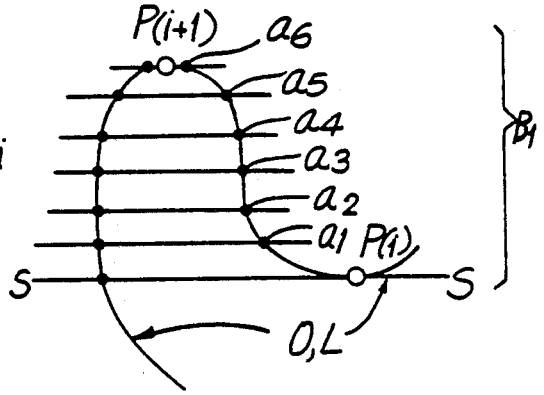

The generation of the stitching data of the lower thread needle means will be stated. Referring to FIGS. 12 and 13, FIG. 12 shows a case of Z(i)=1 and FIG. 13 shows a case of Z(i)=0, the distance between P(i) and P(i+1) of B(i) being equally divided with a pitch d wideth (larger than the thickness of the lower thread) of S S line in the stitching direction. Crossing points of the outlines O and L are assumed as an and bn, and the outer points between an and an+1, and bn and bn+1 are assumed as Cn.

Figure 14:
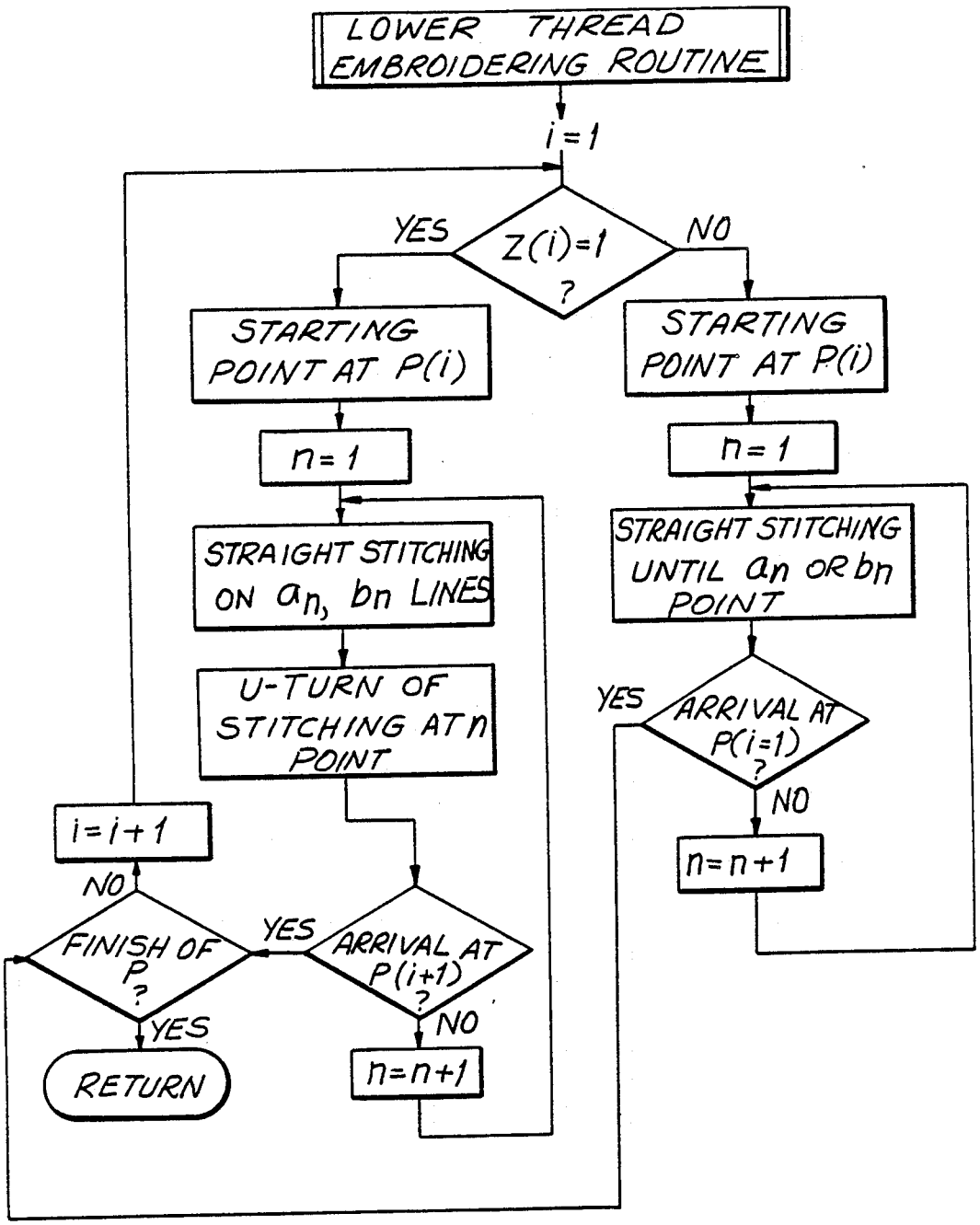
FIGS. 14 is a flow chart of the program for the lower thread embroidering according to the invention.
Figures 15A, 15B, 15C, 15D, 15E:
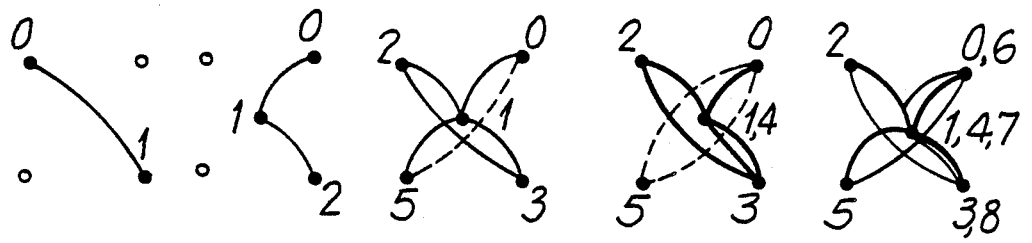
FIGS. 15A to 15E show cross-stitch units for a cross-section embroidering according to the invention.
Figure 17:
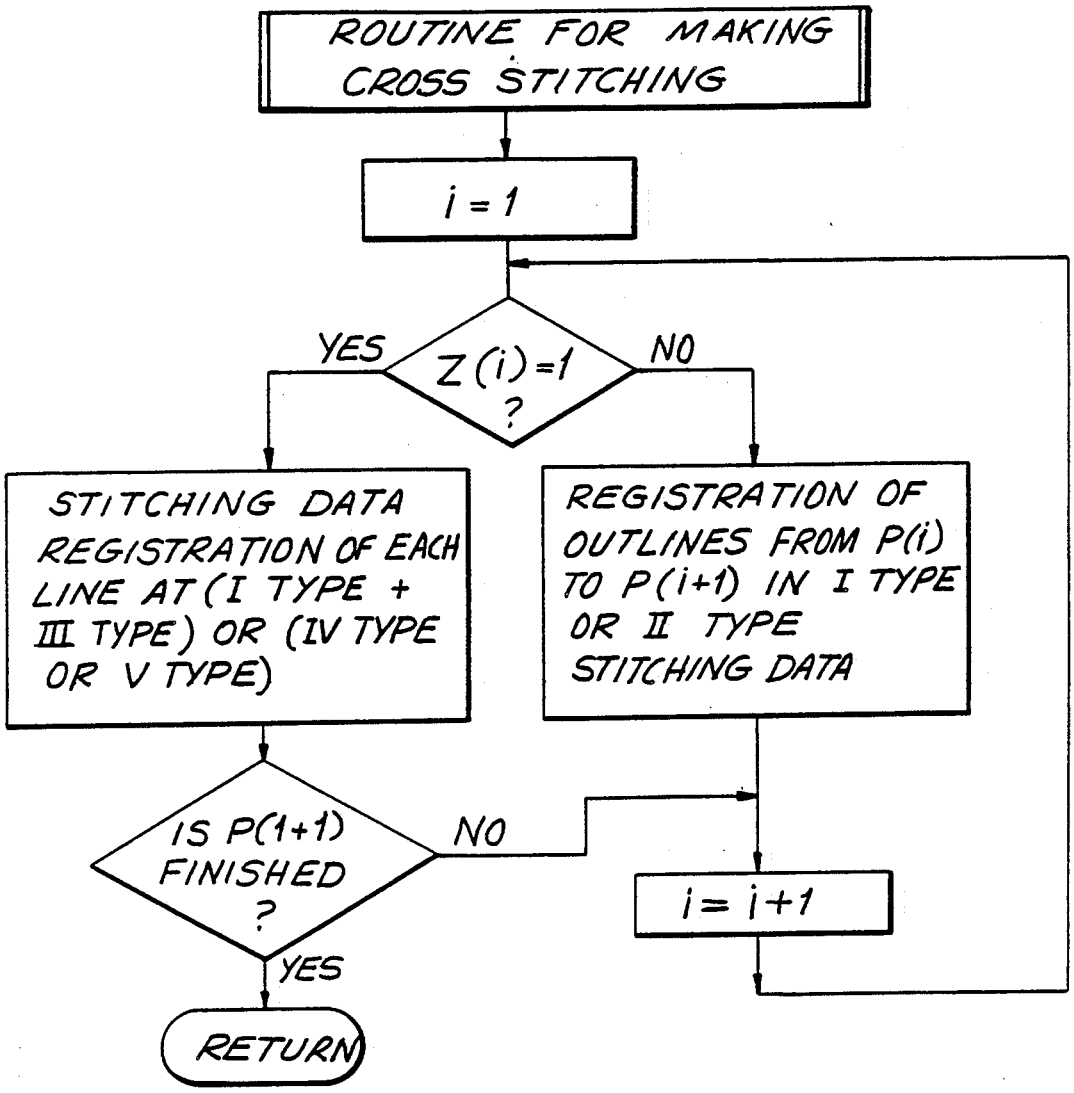

FIG. 14 shows a flow chart of the routine of a program for the embroidering with the lower thread where the above stated treatment is carried out with respect to the block B(i) and the stitching data is made up automatically for the lower thread needle means in accordance with the stitching sequence data.

The cross-stitch embroidering will be now explained. An original pattern is made by combining cross-stitching units (FIGS. 15A to 15E). The numerals 0 to 6 show the stitching sequence, and the dotted lines show the already stitched parts for the jump stitching. The cross stitching may be sectioned with lattices having a size of the unit, having an area deformed by the lines connecting the dots which are apexes of the cross stitch in the stitched pattern. read in form the zigzag embroidering having a little dot. When the cross stitch is sectioned with the defined by the dots, the dots are size registered as the cross dot data.

Figure 16:
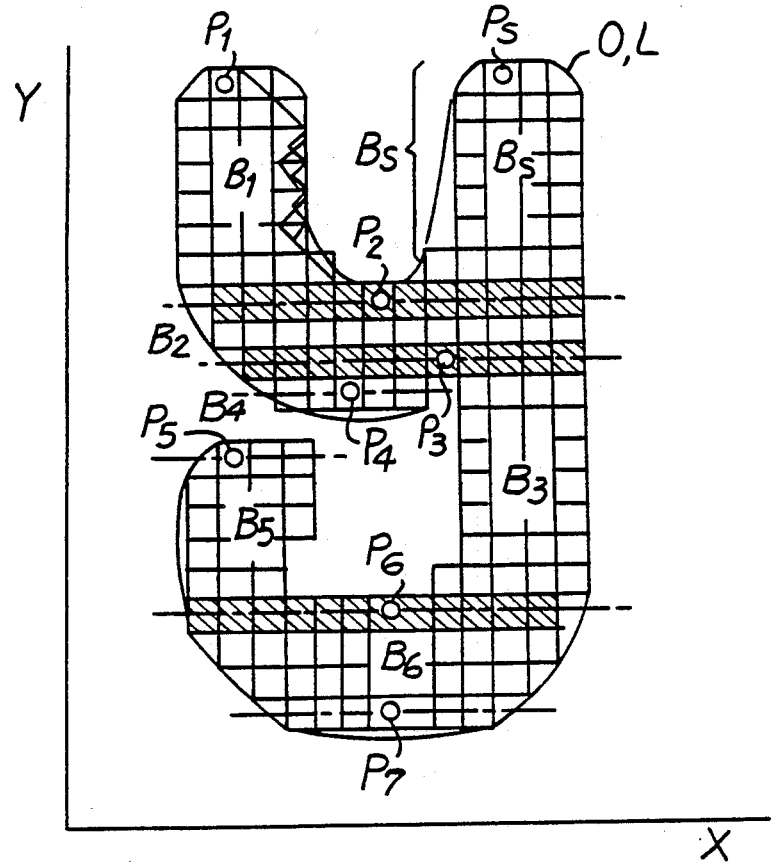
FIG. 16 is a pattern divided into blocks for cross-stitch embroidering.

The divided block where the original pattern is shown in FIG. 2 becomes a lattice pattern of FIG. 16.

Therefore, as making the data of the above mentioned zigzag embroidering, (1) the apex is scanned and registered, (2) the apex-block diagram is made up, (3) the apex-block table is formed.

(4) accumulation of the stitching area is calculated, and the apex-block table is rewritten, (5) the apex-block diagram is revised, and (6) finally, the stitching sequence of the block is determined.

What is claimed:

1. In a computer operated sewing machine provided with a needle attached at a lower part of a needle bar, a drive device for reciprocating the needle bar vertically, a thread loop hook for catching a thread loop carried by the needle, a drive part for moving an embroidering frame in X and Y coordinate directions, and memories or storing data controlling the drive part, a device for automatically preparing embroidering data for a desired pattern to be embroidered, comprising a digitizing input device which scans in a predetermined direction an outline of an original pattern and detects apex points of all concave and convexe portions on said outline, means for registering said apex points in a data memory; means for preparing an embroidering sequence of data blocks pertaining to areas of said pattern separated by scanning lines passing through the respective apex points; and means for registering said embroidering sequence in said data memory.

* * * * *